US006290120B1

(12) United States Patent
Guest

(10) Patent No.: US 6,290,120 B1
(45) Date of Patent: Sep. 18, 2001

(54) CLOSURE SYSTEM

(75) Inventor: Christopher Guest, Brampton (CA)

(73) Assignee: Ontario Inc. cob as Pep, Brampton (CA)

( * ) Notice: Subject to any disclaimer, the term of this patent is extended or adjusted under 35 U.S.C. 154(b) by 0 days.

(21) Appl. No.: 09/220,357

(22) Filed: Dec. 24, 1998

(51) Int. Cl.[7] ..... B65D 27/14
(52) U.S. Cl. ..... 229/80
(58) Field of Search ..... 229/92.1, 92.3, 229/80, 301, 304, 305, 70, 302; 383/62; 428/40.1, 41.8, 352

(56) References Cited

U.S. PATENT DOCUMENTS

| | | | | |
|---|---|---|---|---|
| 2,367,440 | * | 1/1945 | Schieman | 229/80 |
| 2,384,223 | * | 9/1945 | Wilbur | 229/80 X |
| 3,143,279 | * | 8/1964 | Black | 229/304 |
| 3,420,433 | * | 1/1969 | Bostwick | 229/80 |
| 3,866,822 | * | 2/1975 | Faltin et al. | 229/301 X |
| 3,990,627 | * | 11/1976 | Olson | 229/80 X |
| 4,410,130 | * | 10/1983 | Herrington | 383/62 |
| 4,632,427 | | 12/1986 | Angus . | |
| 4,712,729 | | 12/1987 | Craig . | |
| 4,906,108 | * | 3/1990 | Herrington et al. | 383/62 X |
| 5,052,613 | | 10/1991 | Lin . | |
| 5,213,258 | | 5/1993 | Kim . | |
| 5,263,637 | * | 11/1993 | Simson | 229/304 |
| 5,271,553 | | 12/1993 | Kim . | |
| 5,346,123 | | 9/1994 | Lombardo . | |
| 5,375,764 | | 12/1994 | Sauerwine . | |
| 5,400,954 | | 3/1995 | Kaye . | |
| 5,474,229 | | 12/1995 | Shimazaki . | |
| 5,516,040 | | 5/1996 | Lin . | |
| 5,618,062 | * | 4/1997 | Mertens et al. | 283/67 |
| 5,622,390 | | 4/1997 | Jenkins . | |
| 5,642,855 | | 7/1997 | Michlin . | |
| 5,824,380 | * | 10/1998 | Hagen | 383/62 X |
| 5,908,243 | * | 6/1999 | Hanning | 383/62 X |

FOREIGN PATENT DOCUMENTS

| | | | | |
|---|---|---|---|---|
| 670 234 | | 5/1989 | (CH) . | |
| 29 16 960 | | 11/1980 | (DE) . | |
| 29 17 842 | | 11/1980 | (DE) . | |
| 2633901 | | 1/1990 | (FR) . | |
| 583966 | * | 1/1947 | (GB) | 229/80 |
| 2173770 | * | 10/1986 | (GB) | 383/71 |
| 205561 | * | 8/1990 | (JP) | 229/80 |
| 9011943 | * | 10/1990 | (WO) | 229/80 |

* cited by examiner

*Primary Examiner*—Jes F. Pascua
(74) *Attorney, Agent, or Firm*—Eugene J.A. Gierczak

(57) ABSTRACT

A closure system comprised of a passive surface, an engageable surface and an adhesive surface that may be applied to a number or surfaces such as paper and plastic.

5 Claims, 9 Drawing Sheets

Fig 6a
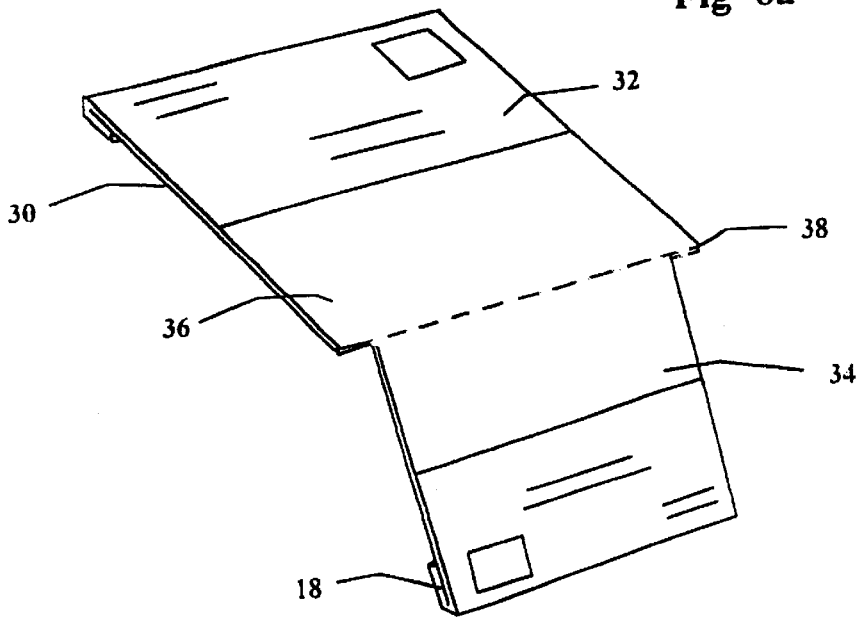
Fig 6b
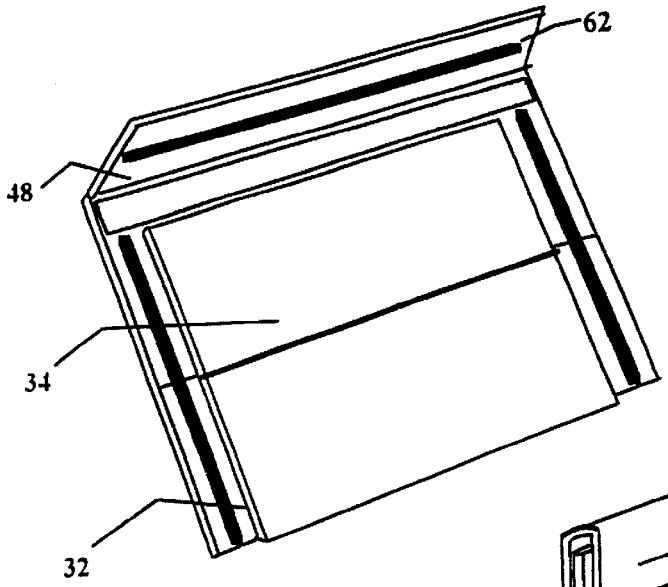
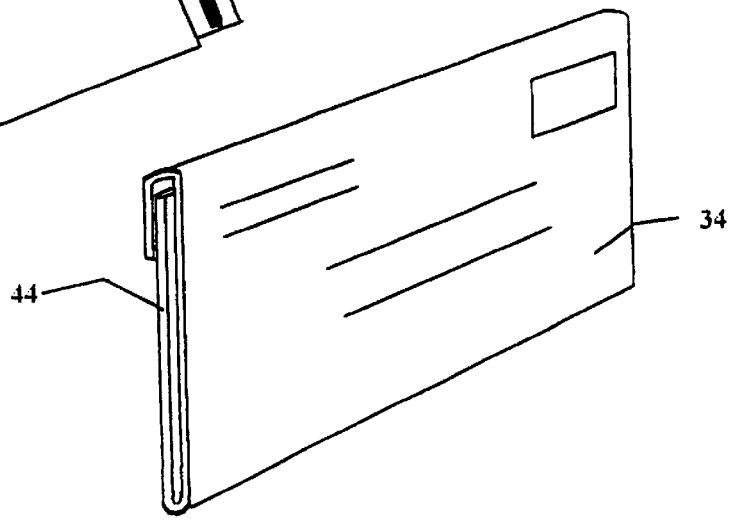
Fig 6c

Fig 7
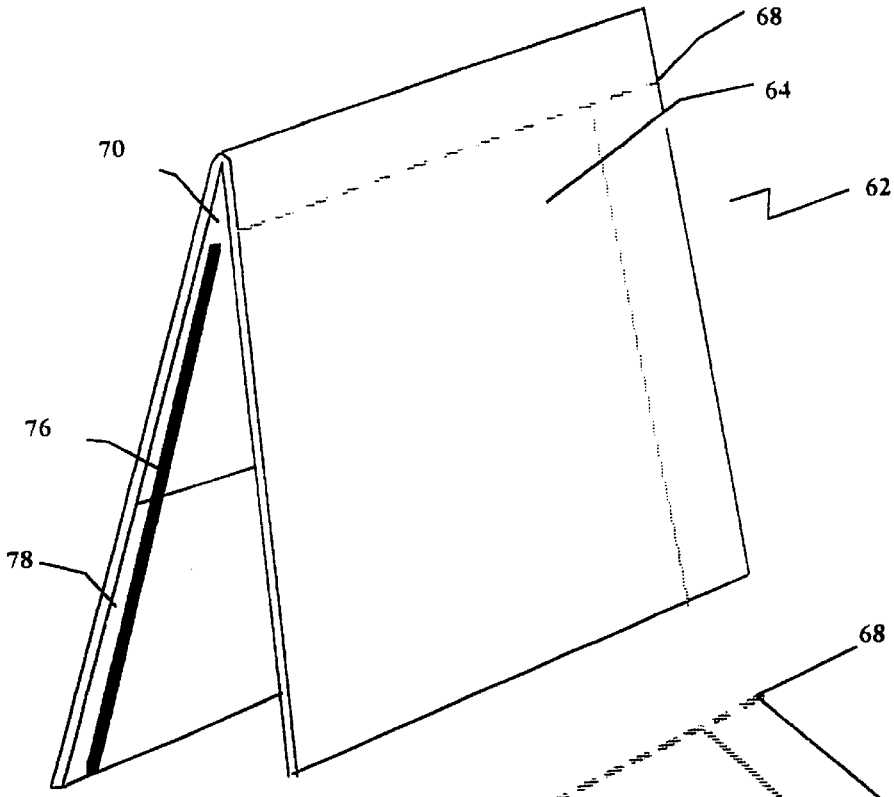
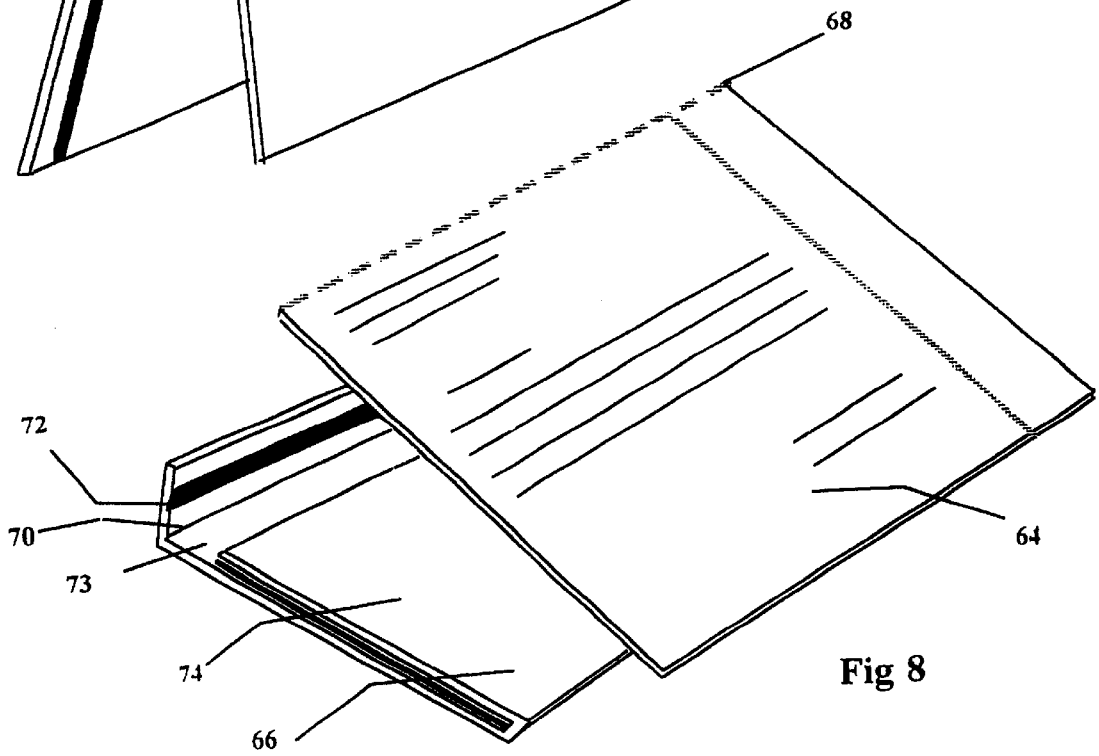
Fig 8

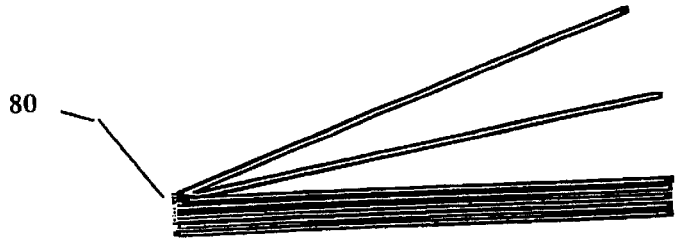
Fig 11a
Fig 11b
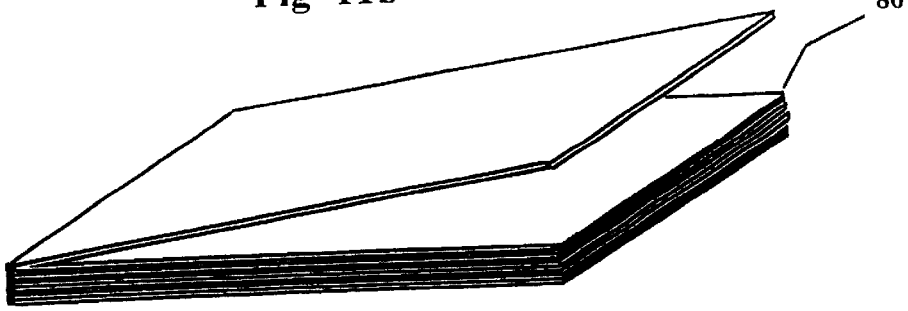
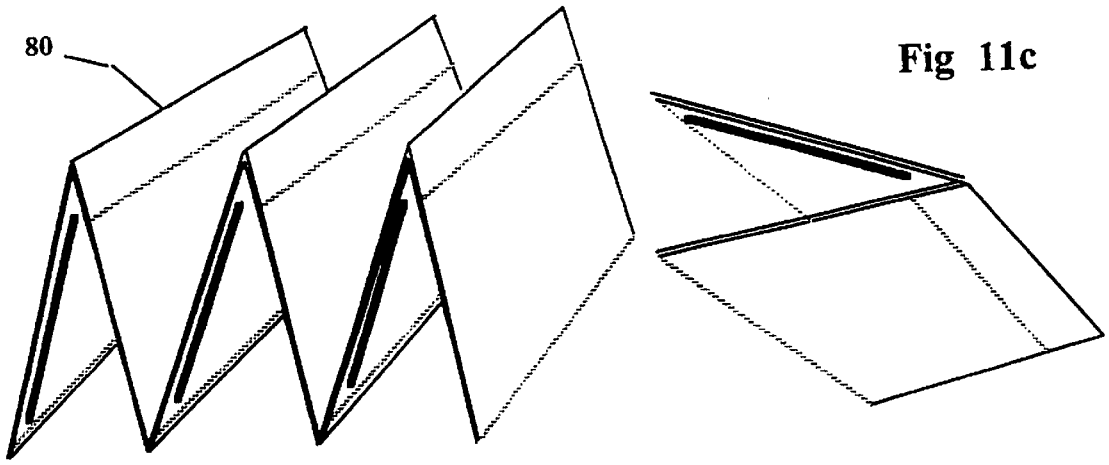
Fig 11c

Fig 12a
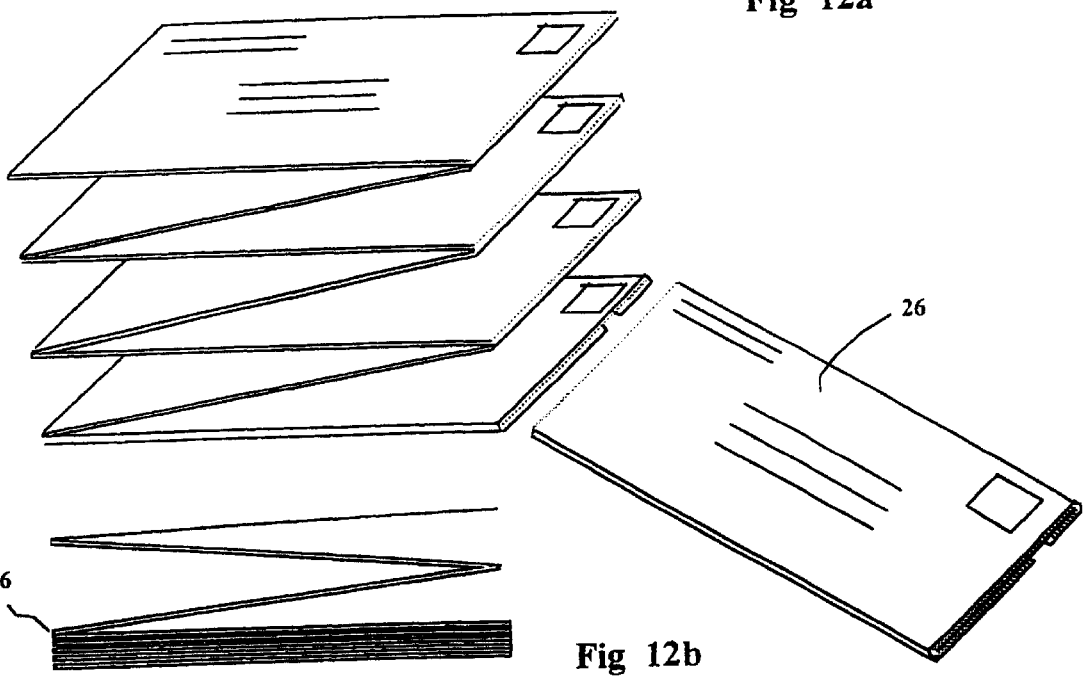
Fig 12b
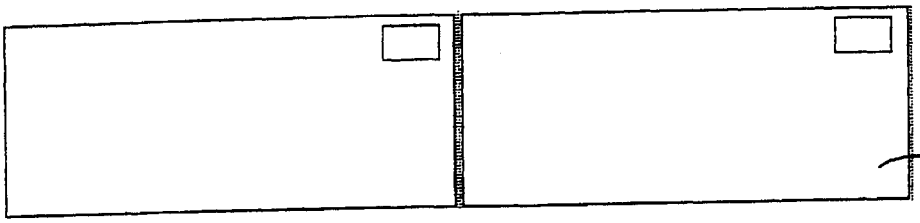
Fig 12c
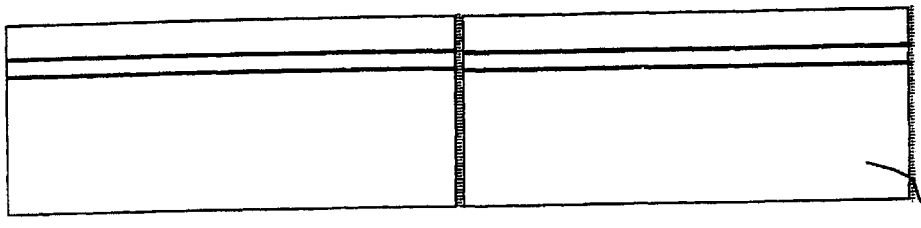
Fig 12d

CLOSURE SYSTEM

FIELD OF INVENTION

This invention relates generally to a closure system and more specifically to a closure system for paper or plastic products.

BACKGROUND OF INVENTION

Since the advent of letter writing, closure systems for paper products such as envelopes have progressed from sealing wax to more innovative closure systems that use a variety of adhesives and sealing mechanisms. Many of these closure systems often require wetting the adhesive or removing an additional element such as a pull tear or release paper.

The purpose for developing some of these closure systems was to improve convenience for the user when sending paper products such as envelopes, as well as trying to increase the confidentiality associated with sending letters. Prior art closure systems have been devised to address some of the aforenoted problems with closure systems.

For example, U.S. Pat. No. 5,474,229 issued to Shimazaki on Dec. 12, 1995 describes a method and apparatus for stacking pressure-sensitive adhesive envelopes. The invention relates to a stack of envelopes wherein each envelope can be easily removed from the stack and used without having to moisten the flap. Specifically the flaps of the envelopes are treated on the backside with a release coating and on the front side with a pressure sensitive adhesive. The envelopes are stacked with the flaps open so that there is an impermanent, adhering interface between the release coating and the pressure sensitive adhesive.

U.S. Pat. No. 5,642,855 issued to Michlin on Jul. 1, 1997 discloses a composite outgoing mailer and return envelope form. The invention describes a one piece Z-folding form for a outgoing mailer. With the removal of tear strips from two sides of the outgoing mailer and removable panels, the remainder may be folded into a return envelope.

U.S. Pat. No. 5,400,594 issued to Kaye on Mar. 28, 1995 discloses a reversible-returnable envelope blank. Specifically the reversible and returnable envelope blank is generally cross-shaped and uses a non-permanent reusable, resealable low tack pressure sensitive adhesive so that the envelope can be folded inside out and used as a return envelope.

U.S. Pat. No. 5,375,764 issued to Sauerwine on Dec. 27, 1994 describes a double parallel heat seal mailer. The invention discloses a double parallel mailer which may include a return envelope with a side edge opening or a booklet. More specifically the mailer includes a first outgoing portion and a return portion which can be detached from the first outgoing portion.

U.S. Pat. No. 5,052,613 issued to Lin on Oct. 1, 1991, describes a two-way envelope. More specifically the invention discloses an envelope that may be used for both an original and return mailers and includes removable and reusable address labels. The invention further describes a number of different ways to fold the mailer so that there is an outgoing portion and a second return portion.

A closure system for both paper and plastic products that does not require any moistening of the adhesive, allows for easy application to envelopes or mailing systems, and allows for easy storage, printing and use of the paper and plastic products is desirable.

SUMMARY OF THE INVENTION

An object of one aspect of the present invention is to provide an improved closure system.

In accordance with one aspect of the invention there is provided a closure system comprising of an engageable surface, a passive surface, and a means for engaging the engageable surface. The passive surface and the means for engaging the engageable surface may be juxtapose to one another so that the passive means and the means for engaging the engageable surface associate with one another in a first unsealed position. The means for engaging the engageable surface may then associate with the engageable surface in a second sealed position.

In accordance with yet another aspect of the invention, there is provided a closure system where the passive means and the means for engaging the engageable surface are disposed parallel to one another.

Preferably, the means for engaging the engageable surface of the closure system may be further defined as a dry pressure sensitive adhesive and the passive means may be further defined as a release film.

In accordance with still another aspect of the invention, the engageable surface may be applied to either to paper or plastic, such as paper envelopes.

Conveniently, the closure system may be applied to a two-way mailer having an outgoing mailer portion and a return mailer where the engageable surface is paper. The closure system may also be applied to a return mailer where the mailer includes a statement portion and a return envelope.

In accordance with a further aspect of the invention, the closure system may be applied to a V-fold form that consists of two connected panels. The closure system may be applied to both connected panels, so that the passive means of the first panel associates with the means for engaging the engageable surface of the second panel; and the passive means of the second panel associates with the means for engaging the engageable surface of the first panel.

Advantages of the present invention are: the passive surface and the means for engaging the engageable surface are juxtaposed to one another so that they can associate in an unsealed position; the closure system may be applied to both paper and plastic; the dry, pressure-sensitive adhesive does not require any moisture to be activated; the association of the passive surface with means for engaging the engageable surface when applied to envelopes, allows for easy manufacturing, storage, printing of the envelopes; the configuration of the closure system allows for different formats and orientations of paper and plastic products, such as envelopes, envelope pouches, two-way mailers, return statement mailers, prescription pads and confidential notes.

BRIEF DESCRIPTION OF DRAWINGS

A detailed description of the preferred embodiments are provided herein below, by way of example only, with reference to the following drawings, in which:

FIGS. 6*a–c*, in perspective front views, illustrate the closure system of FIGS. 4 and 5 in operation.

FIG. 7, in a front perspective view, illustrates the closure system applied to a return mailer in accordance with a preferred embodiment of the present invention.

FIG. 8, in a back perspective view, illustrates the closure system of FIG. 7 in operation.

FIG. 11*a*, in a side view, illustrates the closure system as illustrated in FIG. 9 in a pad format.

FIG. 11*b*, in a perspective view, illustrates the closure system as illustrated in FIG. 11*a*.

FIG. 11*c*, in a perspective view, illustrates the closure system as illustrated in FIG. 9 in a continuous format.

FIG. 12*a*, in a perspective view, illustrates the closure system as illustrated in FIG. 1 in a continuous format.

FIG. 12*b*, in a side view, illustrates the closure system as illustrated in FIG. 12*a*.

FIG. 12*c*, in a top front view, illustrates the closure system as illustrated in FIG. 12*a*.

FIG. 12*d*, in a top back view, illustrates the closure system as illustrated in FIG. 12*a*.

Figure 1:
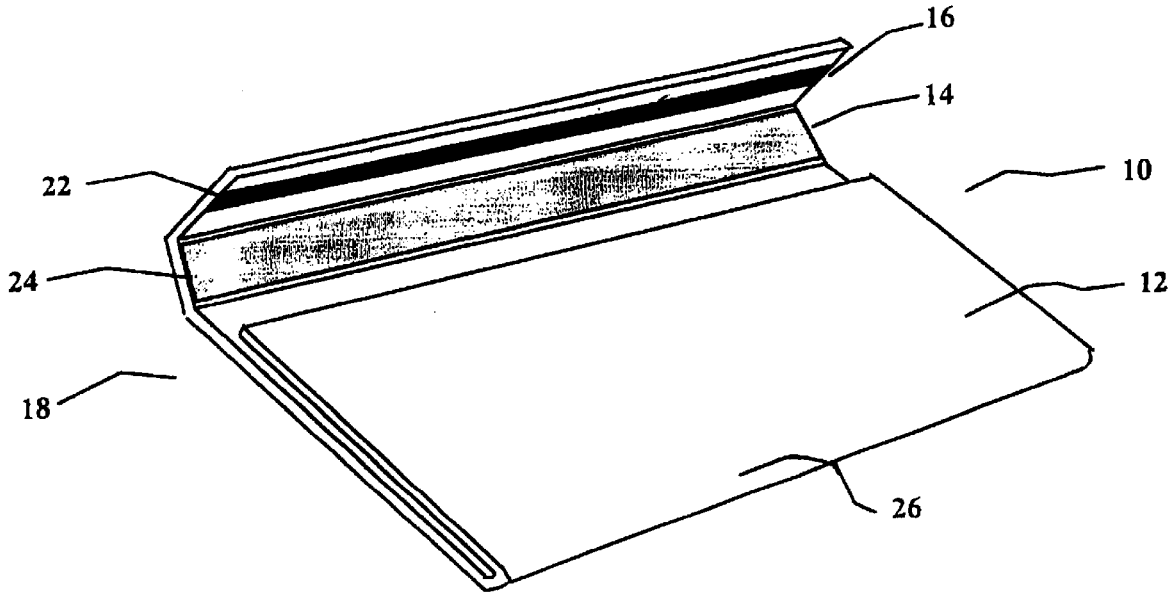
FIG. 1, in a back perspective view, illustrates a closure system in accordance with a preferred embodiment of the present invention.
Figure 2:
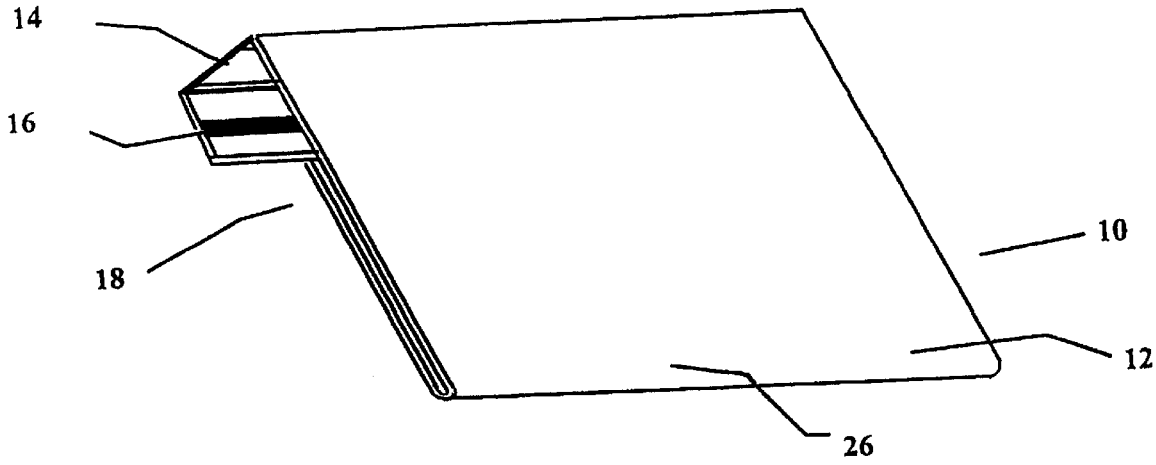
FIG. 2, in a front perspective view, illustrates the closure system of FIG. 1.

In the drawings, preferred embodiments of the invention are illustrated by way of example. It is to be expressly understood that the description and drawings are only for the purpose of illustration and as an aid to understanding and are not intended as a definition of the limits of the invention.

BEST MODE FOR CARRYING OUT THE INVENTION

In the description which follows, like parts are marked throughout the specification and the drawings with the same respective reference numerals. The drawings are not necessarily to scale and in some instances proportions may have been exaggerated in order to more clearly depict certain features of the invention.

Referring to FIGS. 1, 2, and 3*a–c*, there is illustrated a closure system 10 i n perspective views, in accordance with a preferred embodiment of the present invention. The closure system 10 includes an engageable surface 12, a passive surface 14 and a means for engaging the engageable surface 16 . The passive surface 14 and the means for engaging the engageable surface 16 may be positioned juxtaposed to one another on the engageable surface 12.

By placing the passive means 14 and the means for engaging the engageable surface 16 juxtaposed to one another, the passive means 14 and the means for engaging the engageable surface 16 may associate with one another when closure system 10 is in a first unsealed position 18.

The positioning of the passive means 14 and the means for engaging the engageable surface 16 may be further defined so that the passive means 14 and the means for engaging the engageable surface 16 are parallel to one another on the engageable surface 12.

Figure 3A:
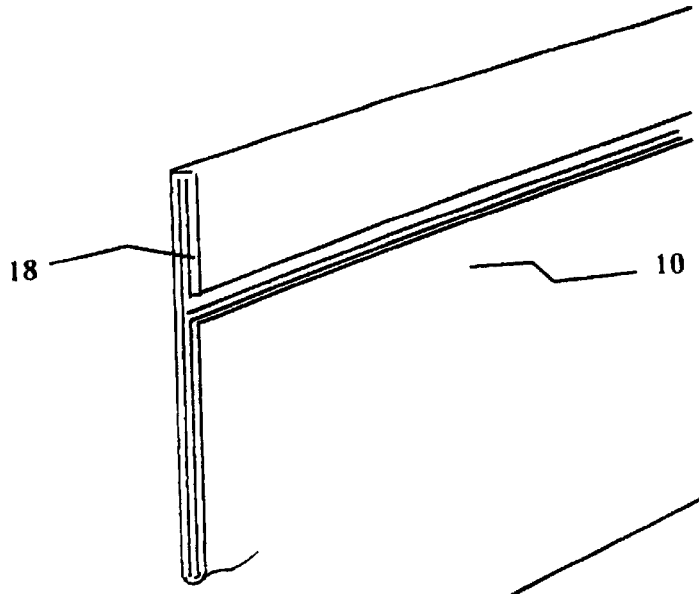
FIGS. 3*a–c*, in back perspective views, illustrate the closure system of FIG. 1 in operation.

Referring to FIG. 3*a*, the first unsealed position 18 may be further defined by the passive means 14 resting against the means for engaging the engageable surface 16. A second sealed position 20 may be defined when the means for engaging the engageable surface 16 associates with the engageable surface 12.

Figure 3B:
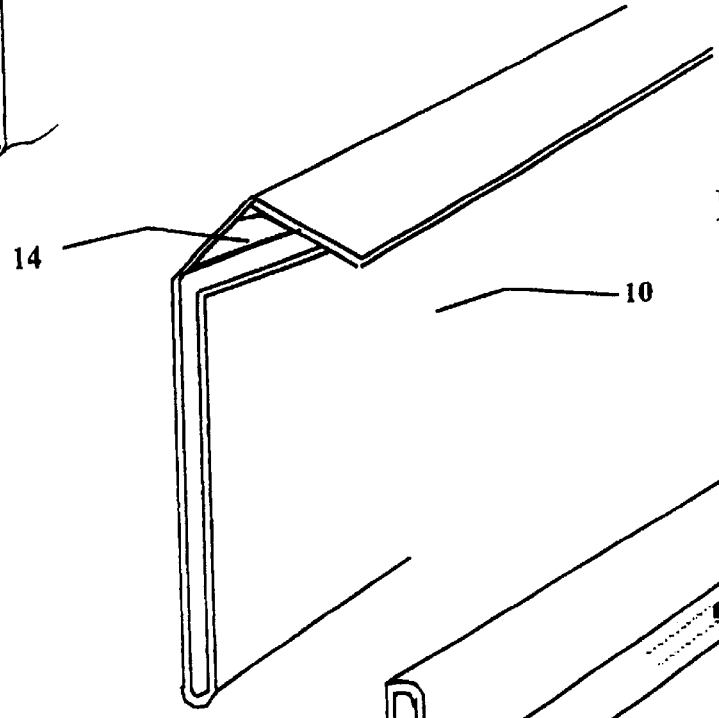
Figure 3C:
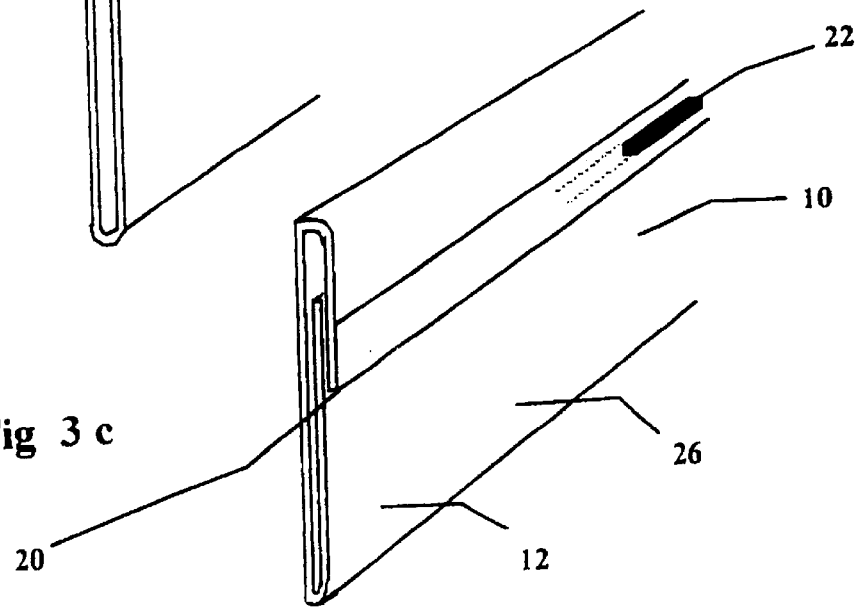
Figure 4:
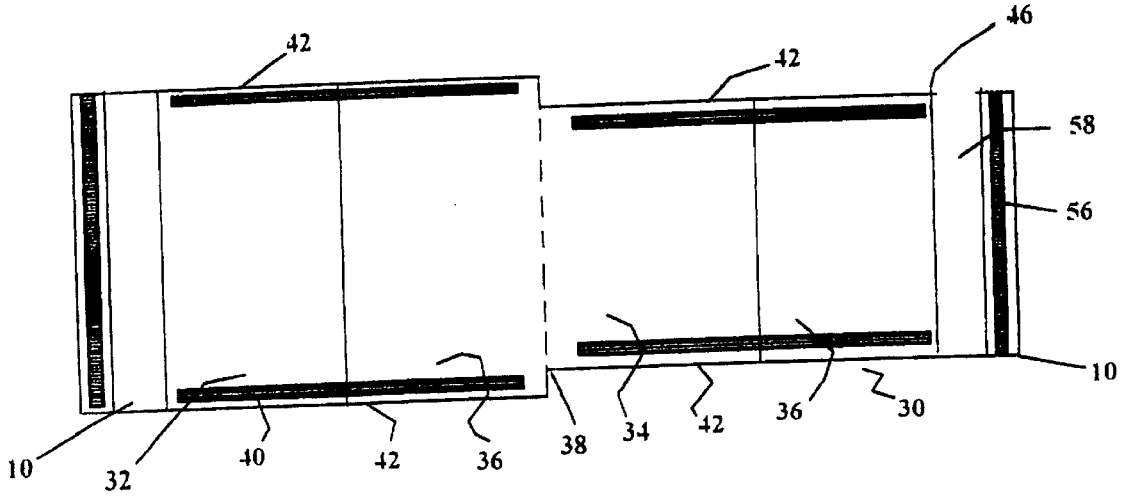
FIG. 4, in a top view, illustrates the closure system applied to a 2-way mailer in accordance with a preferred embodiment of the present invention.
Figure 5:
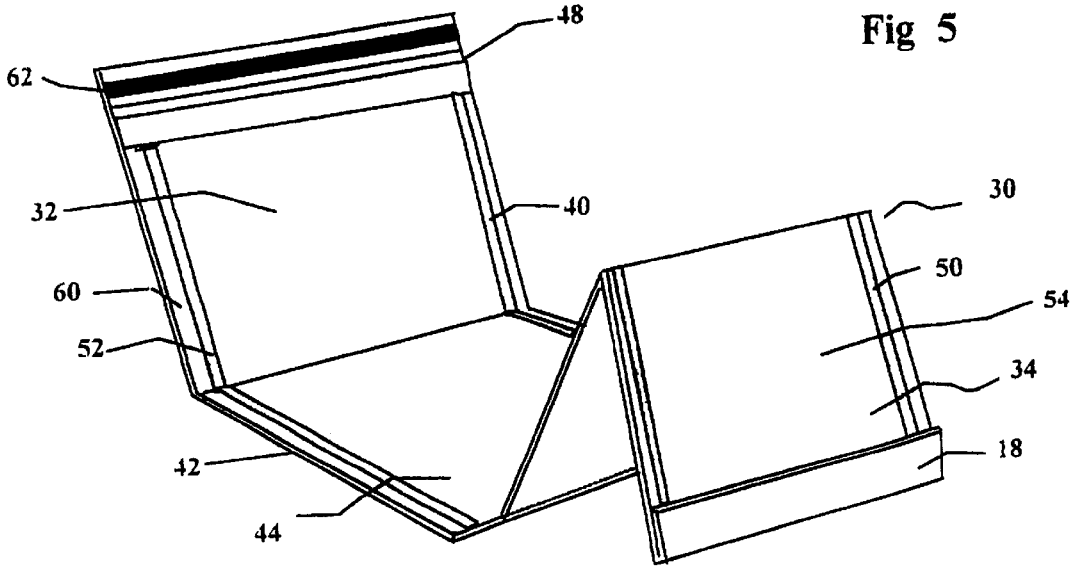
FIG. 5, in a perspective back view, illustrates the closure system of FIG. 4.
Figure 9:
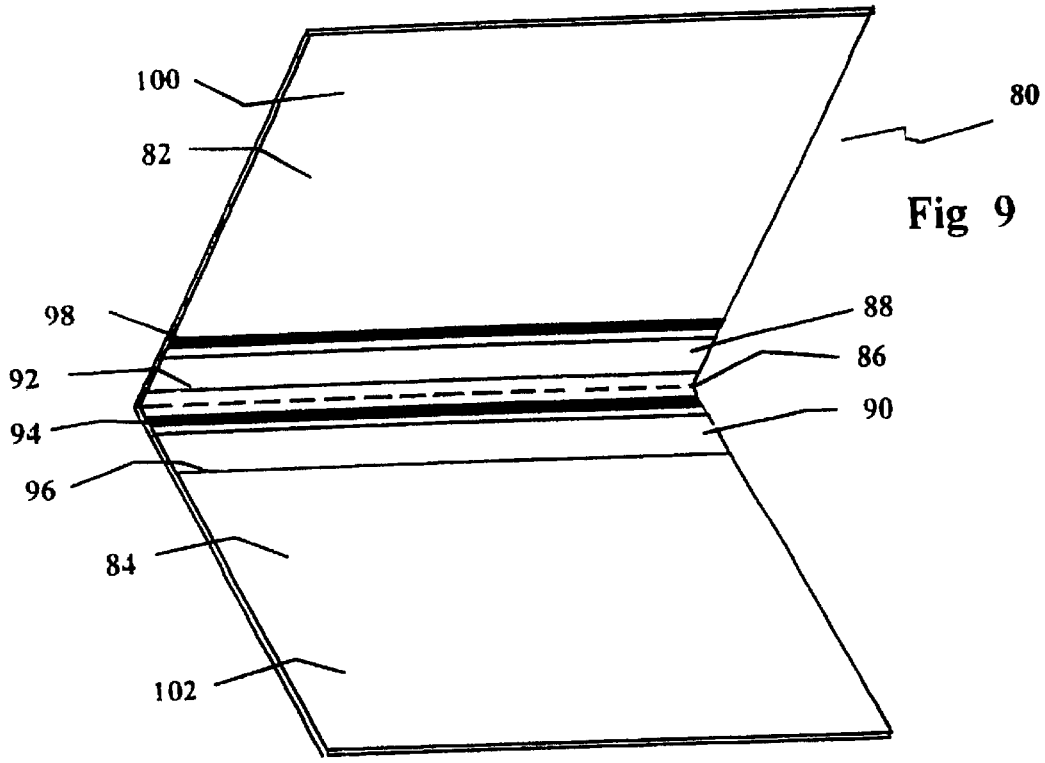
FIG. 9, in a perspective view, illustrates the closure system applied to a V-fold form in accordance with a preferred embodiment of the present invention.
Figure 10:
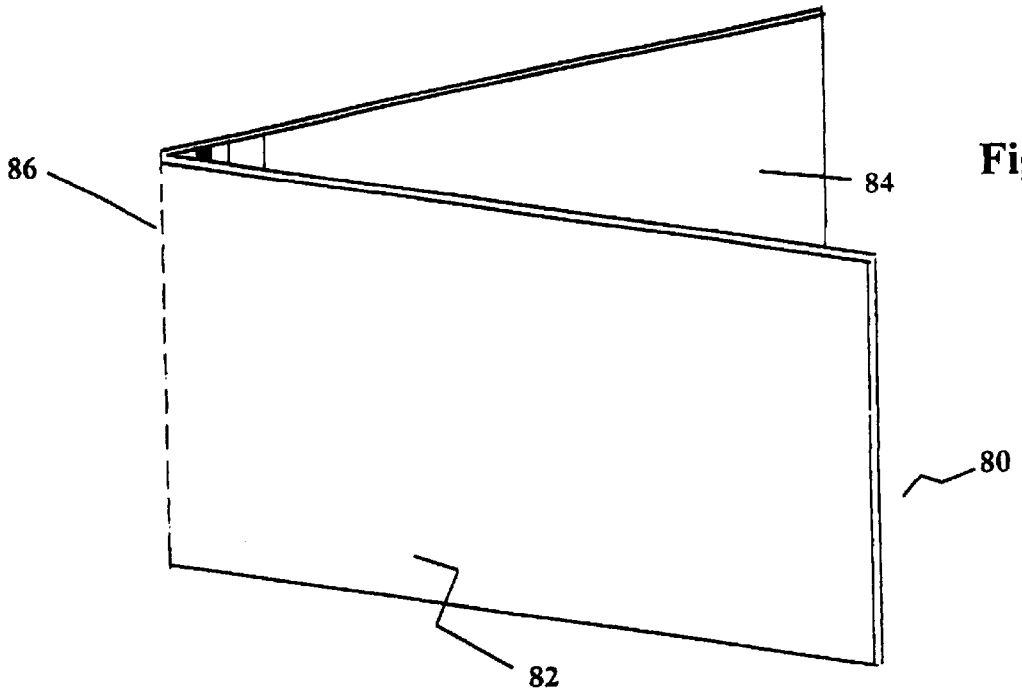
FIG. 10, in a perspective view, illustrates the closure system as illustrated in FIG. 9.

Referring to FIGS. 3*a–c*, in operation, the closure system 10 may be activated from a first unsealed position 18 by lifting the engageable surface 12 that has the means for engaging the engageable surface 16, away from the passive surface 14 where the means for engaging the engageable surface 16 rests in a first unsealed position 18. The means for engaging the engageable surface 16 may then be placed against the engageable surface 12, thereby forming a contact or seal resulting in the second sealed position 20.

The means for engaging the engageable surface 16 may be further defined as a pressure sensitive adhesive 22. The passive surface 12 may be further defined as a release film 24. The release film 24 may include compounds such as a silicon release coating. Both the release film 24 and the pressure sensitive adhesive 22 may be applied to an engageable surface 12 in the configurations described above, wherein the engageable surface 12 is paper or plastic.

The properties of the release film 24 allow for the pressure sensitive adhesive 22 to rest against the release film 24 without adhering or sticking in the first unsealed position 18. When positioned in the second sealed position 20, the pressure sensitive adhesive 22 easily adheres to either paper or plastic, when the user gently presses against the engageable surface 12 that has the dry, pressure sensitive adhesive 22. The properties of the pressure sensitive adhesive 22 allow the user to use minimal pressure to create a secure seal, and does not require the user to wet or moisten the closure system 10 to initiate the activation of the adhesion, as required in most conventional closure systems. Specifically, the closure system 10 is more hygienic as it is does not require licking by the user, and results in a more environmentally friendly product during its manufacture as its production results in almost zero waste.

The closure system 10 may be applied to various articles like a conventional paper envelope 26 as described in FIGS. 1, 2, and 3*a–c*. More specifically, the closure system 10 may be applied by way of example to the following: flat paper envelopes; contoured paper envelopes; 2-way mailers; 3-way mailers; V-fold form system; paper board; corrugated board; card-board package envelopes; air-mail boxes; signage for retail products: prescription forms; confidential memos and message pads; banking security forms; government forms, such as GST and PST tax forms; confidential inter-office correspondence; direct mail advertising and return order forms; pre-paid postage return mailers; company invoicing; inserts for periodicals and magazines; bulletins; and plastic pouches and the like, some of which are further described below.

The paper envelope 26 may be adapted to formulate a variety of different mailing systems. Referring to FIGS. 4, 5, and 6*a–c*, the closure system 10 may be applied to a two-way mailer 30 comprising of an outgoing mailer 32 and a return mailer 34. In this mailing system, the closure system 10 may be applied to both the outgoing mailer 32 and the return mailer 34.

As described above, the closure system 10 may be applied to an engageable surface 36, such as paper, of both the outgoing mailer 32 and the return mailer 34. The outgoing mailer 32 and the return mailer 34 may be connected to one another by a series of perforations 38. A coadhesive 40 may be applied to the outgoing mailer 32 and the return mailer 34 to allow each mailer to be sealed along the sides 42 when the coadhesive 40 adheres to itself. The properties of the coadhesive 40 allow the coadhesive 40 to contact the engageable surface 36 without adhering to it and may be further defined as a water and starch adhesive or a co-hesive adhesive.

Typically the outgoing mailer 32 is larger in size than the return mailer 34, so that the return mailer 34 can fit within the outgoing mailer 32.

Referring to FIGS. 4, 5, and 6*a–c*, in operation, the return mailer 34 of the two-way mailer 30 may be folded so that the return mailer 34 fits inside the outgoing mailer 32. The coadhesive 50 of the return mailer 34 may rest against the engageable surface 44 of the outgoing mailer 32 without adhering to it. The closure system 46 of the return mailer 34 is in the first unsealed position 18, so that the means for engaging the engageable surface 56 is resting against the passive surface 58. The outgoing mailer 32 may be folded then so that the coadhesive 52 of the outgoing mailer 32 seals the sides 60 of the outgoing mailer 32. The closure system 48 of the outgoing mailer 32 may be activated to the second sealed position 20 by placing the means for engaging the engageable surface 62 against the engageable surface 44.

Upon receipt of the outgoing mailer 32, the return mailer 34 may be detached from the outgoing mailer 32 along the perforations 38. The return mailer 34 may be used to enclose information that could be returned to the sender of the outgoing mailer 32. The closure system 46 of the return mailer 34 may be activated in manner described above for the outgoing mailer 32. The configuration of the outgoing mailer 32 and the return mailer 34 with the closure systems, 48 and 46 respectively, allows for the easy insertion of the two-way mailer 30 into printers for printing information on the engageable surface 44 of the outgoing mailer 32, and the engageable surface 54 of the return mailer 34. Storage of the two-way mailer 30 is also trouble-free, as the means for engaging the engageable surface, 56 and 62, and the coadhesive 50 and 52 are in the first unsealed position 18 and can not adhere to any other surfaces.

Referring to FIGS. 7 and 8, the closure system 10 may also be used in conjunction with a return mailer 62. A return mailer 62 may consist of a statement portion 64 and a return envelope 66 connected to one another by a series of perforations 68. The statement portion 64 may contain printed information that the sender wishes to communicate to the recipient. The return envelope 66 may then be used by the recipient to enclose any information that could be conveyed to the sender. The return mailer 66 may include a closure system 70 identical to the closure system 10 described above. The return mailer 62 may be enclosed in an envelope with a closure system 10 as described in FIGS. 1, 2 and 3*a–c* and sent to the recipient.

In operation the recipient of the return mailer 62 may separate the statement portion 64 from the return envelope 66 along the series of perforations 68. The recipient may then return any information or payment to the sender by using the return envelope 66. More specifically, the user would lift the means for engaging the engageable surface 72 away from the passive means 73 and allow the means for engaging the engageable surface 72 to contact the engageable surface 74 and seal the return envelope 66. As described in FIGS. 4, 5, and 6*a–c*, a coadhesive 76 would seal the sides 78 of the return envelope 66. The recipient would therefore keep the statement portion 64 of the return mailer 62 for their records. The orientation of the return mailer 62 allows the user to easily print information on the statement portion 64 and the return envelope 66 without engaging the closure system 70.

Referring to FIGS. 9, 10, 11*a–c*, and 12*a–d*, the closure system 10 may be applied to a V-fold form 80. The V-fold form 80 may comprise of first panel 82 and a second panel 84. The panels 82 and 84 are connected by a series of perforations 86. Both panels 82 and 84 have closure systems, 88 and 90 respectively. The orientation of the closure systems 88 and 90 allows for the following associations. The passive surface 92 of the first panel 82 may associate with the means for engaging the engageable surface 94 of the second panel 84; and the passive means 96 of second panel 84 may associate with the means for engaging the engageable surface 98 of first panel 82. These associations allow for the engageable surface 100 of the first panel 82 to rest against the engageable surface 102 of the second panel 84 without adhering to one another. The closure systems 88 and 90 may be preferably located at the centre of the V-fold form 80, although the closure systems 88 and 90 may be located in a variety of positions (by way of example, horizontal or vertical) to accommodate the many applications of the V-fold form 80.

In operation, the V-fold form 80 may be used where the first panel 82 is detached from the second panel 84 along the series of perforations 86 exposing the second panel 84. As both the first panel 82 and the second panel 84 include closure systems 88 and 90 respectively, the user may fold the engageable surfaces 100 and 102 of either panel and engage the means for engaging the engageable surfaces 94 and 98. By engaging the closure systems 88 and 90 to a second sealed position 20, the user may render any information on the panels 82 and 84 confidential and more difficult to tamper with. The V-fold form 80 may be used in multiples.

By way of example, the V-fold form 80 may be in a pad format as described in FIG. 11, such as prescription pads or confidential note pads. The orientation of the V-fold form 80 allows for the easy insertion into a printer to allow for the printing of information on the engageable surfaces 100 and 102 without exposing the means for engaging the engageable surfaces 94 and 98 to the printing process. This is significant as most conventional closure systems are printed with the adhesive exposed. The V-fold form 80 is manufactured in a flat format, which allows the user to save on storage space as the V-fold form 80 can contain both a letter portion and an envelope portion.

The closure systems 80 and 90 described above may be applied to most paper products, and most plastic products such as plastic pouches. In all instances, the closure systems 80 and 90 allow for information to be printed on the engageable surfaces 100 and 102 using high speed commercial printing equipment resulting in more efficient manufacturing. Printing of the V-fold form 80 can also occur on ink jet or laser printers, any home printing equipment or even labelled by hand. The closure systems 80 and 90 also allow for easy photocopying as the means for engaging the engageable surfaces 100 and 102 do not adhere to any surface such as the heat pad or roller of a photocopying machine.

The closure system 10 also results in a more environmentally friendly product as there is no additional waste from tear strips and perforated edges. By using a pressure-sensitive adhesive 22, the closure system 10 does not require any additional wetting or moisture and is more hygienic since it does not require licking. The mailing systems described above may also be stored in a variety of formats. Referring to FIGS. 12*a–d*, by way of example, the envelope 26 may be manufactured in a continual tear-away format that allows the envelopes 26 to be stored in either a roll or a fan-fold formats. These formats allow for the user to use the envelope 26 in continuous printing.

Various embodiments of the invention have now been described in detail. Since changes in and/or additions to the above-described best mode may be made without departing from the nature, spirit or scope of the invention, the invention is not to be limited to said details.

I claim:

1. A closure system comprising:

(a) an engageable surface;

(b) a passive surface; and (c) a means for engaging said engageable surface;

wherein said passive surface is disposed parallel to said means for engaging said engagable surface, said engageable surface forming a paper V-fold form having two connected panels, each panel having said closure system which associates with the other, so that said passive means of said first panel and said means for engaging said engageable paper surface of said second panel associate; and said passive means of said second panel and said means for engaging said engageable paper surface of said first panel associate.

2. A closure system as claimed in claim 1 wherein said two panels are connected by a series of perforations that allow for the separation of said two panels.

3. A closure system for a paper mailing system comprising:

(a) an engageable paper surface;

(b) a passive surface; and (c) a means for engaging said engageable paper surface disposed parallel to said passive surface on said engageable paper surface, wherein said engageable paper surface forms a V-fold for having two connected panels, each panel having a closure system that associates with the other so that said passive means of said first panel and said means for engaging said engageable paper surface of said second panel associate; and said passive means of said second panel and said means for engaging said engageable paper surface of said first panel associate.

4. A closure system as claimed in claim 3 wherein said two panels are connected by a series of perforations that allow for the separation of said two panels.

5. A closure system for a plastic mailing system comprising:

(a) an engageable plastic surface;

(b) a passive surface; and (c) a means for engaging said engageable plastic surface juxtaposed to said passive surface on said engageable plastic surface, wherein said engageable plastic surface forms a V-fold form having two connected panels, each panel having a closure system that associates with the other so that said passive means of said first panel and said means for engaging said engageable plastic surface of said second panel associate; and said passive means of said second panel and said means for engaging said engageable plastic surface of said fist panel associate.

* * * * *

UNITED STATES PATENT AND TRADEMARK OFFICE

CERTIFICATE OF CORRECTION

PATENT NO. : 6,290,120 B1
APPLICATION NO. : 09/220357
DATED : September 18, 2001
INVENTOR(S) : Guest It is certified that error appears in the above-identified patent and that said Letters Patent is hereby corrected as shown below:

COLUMN 7, LINE 13 DELETE THE COMA (,) AFTER "PANELS" AND REPLACE WITH A PERIOD (.) THE NEXT WORD "EACH" BEGINS A NEW SENTENCE.

Signed and Sealed this

Eighteenth Day of July, 2006

JON W. DUDAS
*Director of the United States Patent and Trademark Office*